US006162306A

United States Patent [19]

Takajo et al.

[11] Patent Number: 6,162,306

[45] Date of Patent: Dec. 19, 2000

[54] ELECTROMAGNETIC STEEL SHEET HAVING EXCELLENT HIGH-FREQUENCY MAGNETIC PROPERITIES AND METHOD

[75] Inventors: Shigeaki Takajo; Takako Yamashita; Akihiro Matsuzaki; Osamu Kondo, all of Chiba, Japan

[73] Assignee: Kawasaki Steel Corporation, Japan

[21] Appl. No.: 09/181,179

[22] Filed: Oct. 28, 1998

[30] Foreign Application Priority Data

| | | | |
|---|---|---|---|
| Nov. 4, 1997 | [JP] | Japan | 9-301828 |
| Feb. 26, 1998 | [JP] | Japan | 10-044802 |
| Mar. 31, 1998 | [JP] | Japan | 10-085771 |

[51] Int. Cl.[7] ..... H01F 1/147

[52] U.S. Cl. ..... 148/309; 420/70; 420/104; 420/117

[58] Field of Search ..... 148/307, 308, 148/309; 420/70, 104, 117

[56] References Cited

U.S. PATENT DOCUMENTS

| | | | |
|---|---|---|---|
| 4,705,581 | 11/1987 | Honkura et al. | 148/307 |
| 4,929,289 | 5/1990 | Moriya et al. | 148/402 |
| 4,933,027 | 6/1990 | Moriya et al. | 148/402 |
| 5,779,819 | 7/1998 | Huppi | 148/308 |

*Primary Examiner*—John Sheehan
*Attorney, Agent, or Firm*—Austin R. Miller

[57] ABSTRACT

Electromagnetic steel sheets which contain Cr in an amount of from about 1.5 to 20% by weight and Si in an amount of from about 2.5 to 10% by weight, while having a total amount of C and N of not larger than about 100 ppm by weight, and which has a specific resistivity of not smaller than about 60 $\mu\Omega\cdot$cm.

3 Claims, No Drawings

ELECTROMAGNETIC STEEL SHEET HAVING EXCELLENT HIGH-FREQUENCY MAGNETIC PROPERITIES AND METHOD

FIELD OF THE INVENTION

The present invention relates to an electromagnetic steel sheet having excellent magnetic properties, especially within a frequency range higher than commercial frequency, and to a method of making the same.

BACKGROUND OF THE INVENTION

Silicon steel is known for its excellent soft magnetic properties. Si steel essentially having an Si content of 3.5% by weight or less is usually employed as iron cores in power-frequency motors, transformers, etc. However, when such Si steel is used within a frequency range of 1 kHz or more, that is higher than commercial frequency, the iron loss caused by eddy currents is excessive. Therefore, Si steels of that type are disadvantageous for use in iron cores in many electric appliances.

With the recent tendency toward small-sized and high-performance electric appliances, there is an increasing demand for high-performance motors, high-frequency transformers, etc. They demand materials having small iron loss.

Within an extremely high frequency range (100 kHz or higher), the eddy-current loss in steel sheets is enormous. Therefore, for use in such an extremely high frequency range, ferrite has heretofore been employed as iron cores, even though its magnetic flux density is low.

In this connection, an increase of Si content of steel brings about an increase in its electric resistance, thereby resulting in reduction of the eddy currents induced in the steel. Therefore, the iron loss of such high-Si steel is favorably reduced within a frequency range higher than commercial frequency. However, Si steel having an Si content larger than 3.5% by weight is extremely hard and brittle, and its workability is poor. Therefore, it is extremely difficult to produce Si steel sheets of that type by rolling. In particular, the workability of Si steel having an Si content greater than 5.0% by weight is so poor that it cannot be subjected to cold rolling, or even to warm rolling.

Regarding the technique directed to the industrial-scale production of steel sheets having an Si content of around 6.5% by weight, hot rolling at a low temperature and under a high reduction, is disclosed in Japanese Patent Application Laid-Open (JP-A) Sho-61-166923, and a method is disclosed for processing steel for Si diffusion penetration, in JP-A Sho-62-227078.

However, the technique disclosed in JP-A Sho-61-166923 requires delicate control of the rolled steel texture for seemingly reducing the brittleness of the steel. Therefore, in the disclosed method, the steel must be strictly controlled in production, and it is difficult to stably produce steel sheets on an industrial scale according to the method. On the other hand, the technique disclosed in JP-A Sho-62-227078 requires specific diffusion coating with Si, and is therefore extremely disadvantageous for industrial production of steel sheets, as being too expensive.

An increase of the Si content in steel up to 6.5% by weight can bring about an increase of specific resistivity to only the level of at most 80 $\mu\Omega\cdot$cm or so. In particular, for steel sheets having an Si content not larger than 3.5% by weight, that could be produced in ordinary industrial rolling methods, the sheets could have a specific resistivity of up to the level of 50 $\mu\Omega\cdot$cm or so. In other words, a further increase of the electric resistance of steel to be attained by Si addition only is limited, and the mere addition of Si to steel is insufficient for obtaining steel having good high-frequency magnetic properties.

In addition, Si steel is said to be further problematic in use for iron cores, as having poor corrosion resistance.

On the other hand, it is known that Al is effective for increasing electric resistance of steel, like Si. Al does not so greatly reduce the workability of steel. Therefore, substituting for a part of Si in steel with Al would seem to be effective for improving the workability of Si steel while increasing its electric resistance. For example, steel containing 3% by weight of Si and 0.7% by weight of Al has better workability than Al-free steel containing 3.7% by weight of Si. Yet both have nearly the same magnetic properties. However, such Al-containing steel is disadvantageous in that Al is more expensive than Si, and that Al causes significant reduction of magnetic flux density of the Al-containing steel. For another type of Al-containing steel having an Si content of not smaller than 3% by weight, in which the total of Si and Al is not smaller than 4% by weight, its workability is also poor, and cold rolling of the steel is impossible. For still another type of Al-containing steel in which the total of Si and Al is more than 6% by weight, its workability is so poor that even warm rolling of the steel is difficult. In short, steel sheets containing Si and Al to such a degree that the total of Si and Al therein is less than 4% by weight could be produced on an industrial scale, but without practical benefit because their specific resistivity could not be over 60 $\mu\Omega\cdot$cm.

Even if the amounts of Si and Al added to steel are increased enough to reduce the iron loss in the resulting Si—Al steel within a high frequency range, the essential workability of the steel would not be improved, the corrosion resistance of the steel would be poor, and that the production costs for the steel would be high.

For improving the corrosion resistance of Si steel, a method is disclosed comprising adding a predetermined amount of Cr to the steel (JP-A Sho-52-24117 and JP-A Sho-61-27352). As in those references, addition of Cr to Si steel is known. However, the magnetic properties of the steel disclosed in those publications are still the same as those of ordinary Cr-free Si steel. The magnetic properties of the steel are not improved to a significant degree by the addition of Cr.

SUMMARY OF THE INVENTION

An object of the present invention is to provide electromagnetic steel sheets which have excellent workability, good high-frequency magnetic properties with high specific resistivity, and even good corrosion resistance, all achieved at low cost. Steel sheets of improved workability could be worked into thinner sheets having even more improved high-frequency magnetic properties.

We have made a novel discovery that, for ensuring good workability of Si steel and Si—Al steel, under certain conditions, adding Cr to Si steel or Si—Al steel is surprisingly effective for improving the workability of the steel.

In this connection, it has heretofore been considered that addition of an increased amount of Cr to steel reduces the workability of the resulting steel. As opposed to this, however, we have found that, even in Si—Al steel having an Si content of at least 3% by weight and an Al content of at least 1% by weight, the presence of a specific amount of Cr improves the workability of the steel when the (C+N) content of the steel is reduced to a critical level.

In addition, we have further discovered that even Cr-containing Si steel or Cr-containing Si—Al steel having a smaller Si content and a smaller Al content and having a specific resistivity of at least 60 $\mu\Omega\cdot$cm can have much improved workability than Cr-free Si steel or Cr-free Si—Al steel having the same degree of specific resistivity, if its (C+N) content is reduced to the requisite level.

Moreover, we have found that the presence of Cr along with Si and Al in steel brings about a synergistic effect in increasing the electric resistance of the steel.

Based on these findings, we have reached the result that the iron loss in such Cr-containing steel, especially within the high frequency range, is reduced much more than Si steel, Al steel or even Si—Al steel containing Si and/or Al but not Cr. In addition, the corrosion resistance of the Cr-added Si steel is significantly improved, more than that of conventional Cr-free Si steel.

This invention provides an electromagnetic steel sheet with excellent high-frequency magnetic properties. It contains Cr in an amount of from about 1.5 to 20% by weight, and Si in an amount of from about 2.5 to 10% by weight, while having a maximum total (C+N) content of about 100 ppm by weight, and which has a specific resistivity of at least about 60 $\mu\Omega\cdot$cm. The steel sheet may contain Al in a maximum amount of about 5% by weight, and/or one or two elements selected from Mn and P, each in a maximum amount of about 1% by weight.

Preferably, the steel sheet has a thickness of from about 0.01 to 0.4 mm.

The invention also provides a method for producing electromagnetic steel sheets with excellent high-frequency magnetic properties, which comprises hot rolling a steel slab containing Cr in an amount of from about 1.5 to 20% by weight, and Si in an amount of from about 2.5 to 10% by weight and having a maximum (C+N) content of about 100 ppm by weight, into sheets having a maximum thickness of about 3 mm.

DETAILED DESCRIPTION OF THE INVENTION

Experiments and data are now described for the purpose of full explanation. The Examples are not intended to define or to limit the scope of the invention, which is defined in the appended claims.

Using raw materials Fe, Cr, Si and Al, all having a purity of at least 99.99%, we prepared Cr-added 4.5 wt. % Si-2 wt. % Al steel ingots having a Cr content of 0, 2, 4 or 12% by weight, in a small-sized, high-vacuum (1×10-4 Torr) melting furnace. The weight of each ingot was 10 kg. Regarding the impurity contents of the steel ingots, the C content was from 5 to 8 ppm by weight, the P content was from 3 to 5 ppm by weight, the S content was from 2 to 3 ppm by weight, the N content was from 12 to 18 ppm by weight, the O content was from 11 to 15 ppm by weight, and the (C+N) content was from 18 to 22 ppm by weight. Each steel ingot was cut into slabs having a thickness of 60 mm, and rolled into sheets having a thickness of 3.2 mm after heating at 1100° C.

From each steel sheet we cut out Charpy test pieces having a thickness of 2.5 mm, a width of 10 mm and a length of 55 mm. Each test piece was V-notched to a length of 2 mm. The lengthwise direction of each test piece was parallel to the rolling direction thereof. All test pieces were subjected to a Charpy test at different temperatures up to 250° C., and the area percent brittle fracture of each test piece at different temperatures was obtained. From the data obtained, the temperature at which the area percent brittle fracture of the test piece shall be 50% was obtained through interpolation. The temperature at which the area percent brittle fracture of a steel sheet is 50% is referred to as the ductility-brittleness transition temperature of the steel sheet; this is known as an index of the toughness of steel. The workability of steel may be evaluated on the basis of this transition temperature. Steel having a lower transition temperature has higher toughness and better workability. The influence of the Cr content of steel on the transition temperature thereof is shown in Table 1.

TABLE 1

| Cr Content (wt %) | Transition Temperature (° C.) |
|---|---|
| 0 | >+250 |
| 2 | +180 |
| 4 | +100 |
| 12 | +80 |
| 18 | +50 |
| 25 | +40 |

Unexpectedly, the transition temperature of steel lowered with the increase in the Cr content thereof, as in Table 1. This means that the workability of steel increased with an increase of the Cr content thereof. In addition, it was verified that Cr added to steel in an amount of at least 2% by weight exhibited a workability improving effect, and that the workability improving effect of Cr addition was saturated even though more than 20% by weight of Cr was added to steel. Steel having a transition temperature of not higher than 200° C. could be subjected to ordinary warm rolling at around 300° C. or so. Steel having a transition temperature of not higher than 100° C. could be, after having been first heated at a temperature not higher than 200° C., subjected to ordinary cold rolling, and is therefore further advantageous in its industrial process.

In the next experiment, we prepared ingots of 4 wt. % Cr-4.5 wt. % Si-2 wt. % Al steel in the same manner as previously, to which, however, we added a matrix alloy of Fe-5 wt. % C and iron nitride so as to control the C content and the N content of those ingots. The steel sheets thus prepared each had a different (C+N) content, and these were subjected to the same Charpy test as previously. The test data obtained are shown in Table 2.

TABLE 2

| (C + N) Content (ppm) | Transition Temperature (° C.) |
|---|---|
| 19 | +100 |
| 48 | +120 |
| 85 | +150 |
| 140 | +210 |

As in Table 2, the workability of steel samples having a (C+N) content of about 100 ppm by weight or lower was significantly improved. Steel having a (C+N) content of about 100 ppm by weight or lower could be subjected to ordinary warm rolling.

Next, of the hot-rolled sheet samples, those of 4 wt. % Cr-4.5 wt. % Si-2 wt. % Al steel having a (C+N) content of 19 ppm by weight, and comparative samples of 6 wt. % Si steel (of which the (C+N) content was 19 ppm by weight) were warm-rolled into thinner sheet samples having a thickness of 0.2 mm, which were then annealed in a hydrogen atmosphere at 1200° C. for 60 minutes. The thus-annealed samples were tested to measure their specific resistivity and magnetic properties. Precisely, the hot-rolled sheet samples of 4 wt. % Cr-4.5 wt. % Si-2 wt. % Al steel were heated at 300° C. and subjected to ordinary warm rolling. However, the comparative samples of 6 wt. % Si steel were too brittle, and could not be subjected to ordinary warm rolling. Therefore, the comparative samples of hot-rolled sheets were heated at 450° C., and rolled into sheets having a thickness of 0.2 mm after having been specifically re-heated in every rolling pass. The thus-rolled sheets of 4 wt. % Cr-4.5 wt. % Si-2 wt. % Al steel had a specific resistivity of 120 $\mu\Omega\cdot$cm, which was much higher than the specific resistivity, 81 $\mu\Omega\cdot$cm of the rolled sheets of 6 wt. % Si steel. The iron loss in the sheets of 4 wt. % Cr-4.5 wt. % Si-2 wt. % Al steel at a frequency of 10 kHz and a magnetic flux density of 0.1 T was 15 W/kg, which was much smaller than the iron loss of 18 W/kg in the sheets of 6 wt. % Si steel.

The present invention is based not only upon the specifically-selected additive components to steel, but upon the purity of the steel.

The reasons for the numerical limitations of the constituent components of steel of the invention are described below.

Cr added to steel acts to greatly increase the electric resistance of steel, owing to the synergistic effect of Si and Al as combined with Cr, thereby reducing the iron loss in the steel within a high frequency range. In addition, Cr is a basic component for improving the corrosion resistance of steel. In particular, even to steel containing Si in an amount of at least 3.5% by weight or containing Si in an amount of at least 3% by weight along with Al in an amount larger than 1% by weight, addition of Cr is extremely effective for improving the workability of the steel, thereby making it possible to subject the steel to ordinary warm rolling. From the viewpoint of improving the workability of steel, Cr shall be added to steel in an amount of at least about 2% by weight. If the Si content and the Al content of steel are less than the ranges noted above, the workability of the steel can be ensured even though a smaller amount of Cr below about 2% by weight is added to the steel. However, in order to ensure the workability improving effect of the Cr addition and to make the steel alloy have a specific resistivity of at least about 60 $\mu\Omega\cdot$cm, addition of Cr in an amount at least about 1.5% by weight is indispensable. On the other hand, if the amount of Cr added is larger than about 20% by weight, the workability improving effect of Cr addition becomes saturated, and addition of such a large amount of Cr causes increase of the production costs. For these reasons, the Cr content of the steel sheet of the invention is defined to fall between about 1.5 and 20% by weight, but preferably between about 2 and 10% by weight, more preferably between about 3 and 7% by weight.

Si addition to steel acts to greatly increase the electric resistance of steel, owing to the synergistic effect of Cr as combined with Si, thereby reducing the iron loss in the steel within a high frequency range. If the amount of Si added to steel is smaller than about 2.5% by weight, the steel does not have an increased specific resistivity of at least about 60 $\mu\Omega\cdot$cm without so much lowering its magnetic flux density, even when Cr and Al are added to the steel along with Si. On the other hand, however, if the amount of Si added is larger than about 10% by weight, the workability of the steel cannot be ensured to such a degree that the steel could be subjected to ordinary warm rolling even when Cr is added to the steel along with Si. For these reasons, the Si content of the steel sheet of the invention is defined to fall between about 2.5 and 10% by weight, but preferably between about 3 and 7% by weight, more preferably between about 3.5 and 5% by weight.

Like Si, Al is effective for greatly increasing the electric resistance of steel, owing to the synergistic effect of Cr as combined with Al, thereby reducing the iron loss in the steel within a high frequency range. Therefore, in the invention, Al may be optionally added to the steel sheet. However, adding Al in an amount of larger than about 5% by weight causes a significant increase in the production costs. In addition, if too much Al is added to the steel sheet of the invention having an Si content of about 2.5% by weight or more, the workability of the steel sheet cannot be ensured to such a degree that the steel sheet could be subjected to ordinary warm rolling even when Cr is added to the steel sheet. For these reasons, therefore, the maximum Al content of the steel sheet of the invention should be about 5% by weight. For improving the deoxidizability of the steel and promoting the grain growth in the steel sheet, Al must be added to the steel sheet in an amount of from about 0.005 to 0.3% by weight or so. In addition, in order to positively use Al for increasing the electric resistance of the steel sheet of the invention having an Si content of about 2.5% by weight or more, adding Al to the steel sheet in an amount of smaller than about 0.5% by weight is ineffective. Therefore, the amount of Al to be added to the steel sheet of the invention is preferably from about 0.005 to 5% by weight, more preferably from about 0.5 to 3% by weight.

C and N, if present, lower the toughness of Cr—Si steel. Therefore, their percentages must be as small as possible. In the steel sheet of the invention of which the Cr content, the Si content and the Al content are within the ranges defined above, the maximum total amount of C and N must be reduced to about 100 ppm by weight in order to ensure good workability of the steel sheet. Preferably, the total amount of C and N is at most about 60 ppm by weight, more preferably at most about 30 ppm by weight. For individual cases of C and N, preferably, the maximum C content is about 30 ppm by weight and the maximum N content is about 80 ppm by weight, more preferably, the maximum C content is about 10 ppm by weight and the maximum N content is about 20 ppm by weight.

The amount of the other impurities except C and N is not specifically defined. However, the preferred ranges of the other impurities are as follows: maximum S is about 20 ppm by weight, preferably about 10 ppm by weight, more preferably about 5 ppm by weight. Maximum O is about 50 ppm by weight, preferably about 30 ppm by weight, more preferably about 15 ppm by weight. The maximum total amount of the impurities C+S+N+O is preferably about 120 ppm by weight, more preferably about 50 ppm by weight.

It is known that Mn and P, if added to Cr—Si steel, further increase the electric resistance of the steel. Adding those components to the steel of the invention attains further reduction in the iron loss in the steel, without interfering with the workability of the steel. Therefore, in the present invention, one or two elements selected from Mn and P may be added to steel. However, adding too much Mn and P to steel substantially increases the production costs. Therefore, the maximum amount of those components to be added shall be about 1% by weight each, more preferably about 0.5% by weight each.

In the present invention, any conventional alloy components may be further added to steel for the purpose of further improving the magnetic properties, the corrosion resistance and the workability of the steel, as not interfering with the toughness of the steel. Some typical examples of such additional components will be mentioned below.

A maximum Ni of about 5% by weight can be a corrosion resistance-improving component. In addition, this lowers the ductility-brittleness transition temperature of steel, while improving the workability thereof. In addition, as facilitating easy creation of fine grains in steel, Ni tends to reduce the eddy-current loss in steel, while reducing the high-frequency iron loss therein. Maximum Cu of about 1% by weight may exhibit the same effect as Ni. Maximum Mo and W of about 5% by weight improve the corrosion resistance of steel. La, V and Nb of maximum about 1% by weight, and Ti, Y and Zr of maximum about 0.1% by weight, and even B of maximum about 0.1% by weight increase the toughness of steel, while improving workability. A maximum Co of about 5% by weight increases the magnetic flux density of steel, and is additionally effective for reducing the iron loss in steel. Sb and Sn of maximum about 0.1% by weight improve the texture of steel, and are additionally effective for reducing the iron loss in steel.

A method of producing steel sheet of this invention is described below.

In producing a melt of Cr—Si steel or Cr—Si—Al steel of the invention, it is desirable to use, as starting materials, high-purity electrolytic iron, electrolytic chromium, metal Si and metal Al, all having a purity of at least about 99.9% by weight. Where Mn and P are added to the steel, it is also desirable to use high-purity materials of those elements. Where the steel melt is produced in a converter, it is necessary that the steel melt produced is fully refined to have a predetermined purity and that the steel melt is not contaminated in the post-treating steps. Apart from a converter, the steel melt may be produced, for example, in a high-vacuum melting furnace (having a reduced pressure of not higher than $10^{-3}$ Torr).

The steel ingots thus produced in the manner noted above are hot-rolled into sheets as thin as possible, which have good rollability in the next cold-rolling or warm-rolling step. For steel sheets having an Fe—Cr—Si alloy composition of the invention, it is believed that the toughness of the surface part of the hot-rolled sheets is higher than that of the center part thereof, and therefore the total workability become better. In order to make the steel sheets of the invention have better rollability, it is desirable that the maximum thickness of the hot-rolled sheets is about 3 mm, preferably about 2.5 mm, more preferably about 1.5 mm.

Since the workability of the hot-rolled sheets of the invention is good, the sheets can be further warm-rolled or cold-rolled to have a maximum reduced thickness of about 0.4 mm. It has heretofore been known that, in ordinary steel sheets having reduced thickness, the eddy-current loss is advantageously reduced especially within a high frequency range, and the iron loss is thereby reduced. However, conventional steel sheets having a high specific resistivity have poor workability and, when rolled in an ordinary manner, they can be thinned to have a reduced thickness of at least about 0.5 mm or so. In addition, it has heretofore been considered that, if conventional steel sheets are merely thinned to have a reduced thickness, the hysteresis loss in the thinned sheets is rather increased and therefore the iron loss therein could not be reduced to a satisfactory degree. As opposed to the conventional knowledge, however, the iron loss in steel sheets having the specific alloying composition and having the specific purity of the present invention, can be lowered to a satisfactory degree even within the high frequency range, merely by reducing the thickness of the sheets. In order to obtain the intended results through thickness reduction in steel sheets, it is effective to make the steel sheets have a maximum reduced thickness of about 0.4 mm. However, thickness reduction to smaller than about 0.01 mm would be disadvantageous in view of high production costs and of the current technical level. Therefore, in the present invention, the thickness of the steel sheets may be defined to fall between about 0.01 and 0.4 mm, preferably between about 0.03 and 0.35 mm.

Since the workability of the steel material of the invention is good, the invention does not require any additional treatment for ensuring and improving the workability of the steel sheets, for example, by annealing the hot-rolled sheets, or by subjecting them to intermediate annealing in the course of cold rolling or warm rolling, being different from the conventional methods for producing steel sheets. Therefore, for improving working capacity, saving energy consumption and reducing production costs in the invention, annealing of hot-rolled sheets and even intermediate annealing of cold-rolled or warm-rolled sheets can be omitted.

For annealing and surface-treating the sheets of the invention, the same steps as those for ordinary electromagnetic steel sheets and electromagnetic stainless steel sheets apply.

The invention is described in more detail with reference to the following Examples, which, however, are not intended to restrict the scope of the invention.

EXAMPLE 1

As raw materials, used herein were electrolytic iron and electrolytic chromium both having a purity of 99.99% by weight, the metal Si having a purity of 99.999% by weight, and optionally the metal aluminum having a purity of 99.99% by weight, the metal manganese having a purity of 99.9% by weight, and Fe-23 wt. % P base alloy having a purity of 99.5% by weight. The raw materials were melted in a small-sized, high-vacuum ($1\times10^{-4}$ Torr) melting furnace, in different compositional ratios shown in Table 3 below. Thus were prepared different types of steel ingots each weighing 10 kg, as in Table 3. To the samples not containing Al as the essential ingredient, added was 1 g (corresponding to 0.01% by weight) of degreased aluminum foil for deoxidation. Of those steel ingots, cut out were steel pieces having a size of 40 mm width×60 mm thickness×100 mm length. These steel pieces were heated at 1100° C. in Ar, then kept as such for 30 minutes, and thereafter hot-rolled into sheets having a thickness of 20 mm. The rolled sheets were re-heated at 1100° C., kept at the temperature for 15 minutes, and then further hot-rolled into thin sheets having a thickness of 2.3 mm.

TABLE 3

(units: wt. %, or wt. ppm)

| Steel No. | C (ppm) | Si (%) | Mn (%) | P (ppm) | S (ppm) | Cr (%) | Al (%) | N (ppm) | O (ppm) | C + N (ppm) | Remarks |
|---|---|---|---|---|---|---|---|---|---|---|---|
| 1 | 18 | 3.1 | 0.005 | 3 | 6 | — | 0.009 | 10 | 15 | 28 | Comparative Sample |
| 2 | 7 | 3.8 | 0.004 | 5 | 5 | 1.1 | 0.011 | 8 | 9 | 15 | Comparative |

TABLE 3-continued (units: wt. %, or wt. ppm)

| Steel No. | C (ppm) | Si (%) | Mn (%) | P (ppm) | S (ppm) | Cr (%) | Al (%) | N (ppm) | O (ppm) | C + N (ppm) | Remarks |
|---|---|---|---|---|---|---|---|---|---|---|---|
| | | | | | | | | | | | Sample |
| 3 | 5 | 3.8 | 0.006 | 5 | 5 | 4.9 | 0.006 | 12 | 14 | 17 | Comparative Sample |
| 4 | 11 | 1.6 | 0.003 | 5 | 5 | 4.8 | 0.009 | 10 | 15 | 21 | Comparative Sample |
| 5 | 2 | 5.9 | 0.003 | 3 | 2 | 5.0 | 0.010 | 5 | 9 | 7 | Sample of the Invention |
| 6 | 6 | 3.7 | 0.23 | 0.41% | 3 | 5.9 | 0.010 | 11 | 13 | 17 | Sample of the Invention |
| 7 | 8 | 3.9 | 0.006 | 2 | 3 | 4.5 | 0.85 | 11 | 11 | 19 | Sample of the Invention |
| 8 | 27 | 3.8 | 0.22 | 4 | 5 | 4.9 | 0.010 | 36 | 20 | 63 | Sample of the Invention |
| 9 | 44 | 3.9 | 0.22 | 4 | 6 | 4.9 | 0.009 | 63 | 17 | 107 | Comparative Sample |
| 10 | 1 | 4.8 | 0.002 | 1 | 2 | 5.3 | 0.005 | 5 | 6 | 6 | Sample of the Invention |
| 11 | 0.6 | 6.4 | 0.002 | 2 | 2 | 18.3 | 0.020 | 4 | 5 | 5 | Sample of the Invention |
| 12 | 5 | 6.5 | 0.005 | 4 | 4 | — | 0.010 | 9 | 9 | 14 | Comparative Sample |

Of each hot-rolled sheet, cut out were Charpy test pieces having a thickness of 1.5 mm, a width of 10 mm and a length of 55 mm. Each test piece was V-notched to a length of 2 mm. The lengthwise direction of each test piece was parallel to the rolling direction thereof. All test pieces were subjected to a Charpy test at different temperatures at intervals of 25° C. up to 250° C., in which the area percent brittle fracture of each test piece tested at different temperatures was obtained. From the data obtained, the ductility-brittleness transition temperature of each test piece, at which the area percent brittle fracture of the test piece was 50%, was obtained.

Next, the hot-rolled sheet samples were shot-blasted, and then finally rolled to have a thickness of 0.20 mm. The samples of which the transition temperature was not higher than room temperature were cold-rolled without being annealed. The samples of which the transition temperature was higher than room temperature but not higher than 200° C. were warm-rolled after having been pre-heated at 300° C. The samples of which the transition temperature was higher than 200° C. were warm-rolled while being heated at a temperature of 450° C. These were re-heated in that manner in every rolling pass. Of those rolled sheets, cut out were test rings having an outer diameter of 30 mm and an inner diameter of 20 mm, which were then annealed in a hydrogen atmosphere at 1000° C. for 60 minutes. Around the thus-annealed rings, a primary coil and a secondary coil were wound. Each of the thus-coiled rings was connected with a BH analyzer, and magnetized at a frequency of 10 kHz, and the iron loss in each ring was measured relative to the magnetic flux density of 0.1 T. On the other hand, test pieces having a width of 30 mm and a length of 280 mm were cut out of each rolled sheet sample, and annealed in a hydrogen atmosphere at 1000° C. for 60 minutes. The specific resistivity of each annealed test piece was measured according to a four-terminal method. Table 4 shows the data of the transition temperature of each steel sample, the heating method for warm-rolling, the specific resistivity, and the iron loss.

For corrosion resistance, the samples were subjected to a salt spray test for 2 hours, according to JIS Z2371, and the percentage of the rusted area of the surface of each sample was measured. The samples of which the rusted area was not larger than 20% were evaluated "good"; those of which the rusted area was larger than 20% but not larger than 80% were evaluated "medium"; and those of which the rusted area was larger than 80% were evaluated "poor".

TABLE 4

| Steel No. | Transition Temperature (° C.) | Cold/Warm Rolling | Specific Resistivity ($\mu\Omega$cm) | Iron Loss (W/kg) | Corrosion Resistance | Remarks |
|---|---|---|---|---|---|---|
| 1 | +80 | warm rolling | 54 | 26 | poor | Comparative Sample |
| 2 | +90 | warm rolling | 67 | 23 | poor | Comparative Sample |
| 3 | −50 | cold rolling | 83 | 18 | good | Sample of the Invention |
| 4 | −50 | cold rolling | 53 | 29 | medium | Comparative Sample |
| 5 | +50 | warm rolling | 105 | 16 | good | Sample of the Invention |
| 6 | −20 | cold rolling | 88 | 17 | good | Sample of the Invention |
| 7 | −60 | cold rolling | 98 | 16 | good | Sample of the Invention |
| 8 | +30 | warm rolling | 83 | 19 | good | Sample of the Invention |
| 9 | +110 | warm rolling | 84 | 21 | average | Comparative Sample |

TABLE 4-continued

| Steel No. | Transition Temperature (° C.) | Cold/Warm Rolling | Specific Resistivity (μΩcm) | Iron Loss (W/kg) | Corrosion Resistance | Remarks |
|---|---|---|---|---|---|---|
| 10 | −70 | cold rolling | 96 | 15 | good | Sample of the Invention |
| 11 | +70 | warm rolling | 85 | 18 | poor | Comparative Sample |
| 12 | >+250 | warm rolling 450° C. | 85 | 18 | poor | Comparative Sample |

Steel 1 is a comparative sample of conventional steel (3 wt. % Si). Steel 2 is a comparative sample, of which the Cr content was smaller than the range defined in the invention. Although the iron loss in Steel 2 was reduced due to the increase in Si therein, the workability of Steel 2 was worse than that of Steel 1, and the corrosion resistance of the former was also worse than that of the latter. Steel 3 is a sample of the invention, which had good workability and high corrosion resistance, and in which the iron loss was small. Steel 4 is a comparative sample in which Si was smaller than the defined range. Its workability was good, but the iron loss therein was the same level as that in Steel 1. Steel 5 is a sample of the invention of which the Si content was higher than that of Steel 3. Since its C content and N content were both reduced, the workability of Steel 5 was better than that of Steel 3, and the iron loss in Steel 5 was much reduced.

Steel 6 and Steel 7 are both samples of the invention, to which were added any of Al, P and Mn. These had good workability, and the iron loss in them was small.

In Steel 8 and Steel 9, the amount of (C+N) was increased. The (C+N) content of Steel 9 was much increased, overstepping the defined range in the invention. The workability of Steel 9 was poor, and the iron loss therein was relatively large.

Steel 10 is a sample of the invention, of which the C content and the N content were much reduced. The workability of Steel 10 was very good, and the iron loss therein was much reduced. Steel 10 was an excellent sample.

Of Steel 11, the Si content was increased to 6.4% by weight, and the Cr content was much increased along with the increase in Si therein. In addition, (C+N) content of Steel 11 was low. The great increase in Cr in this sample of Steel 11 ensured the good workability of itself. Since the specific resistivity of this sample was high, the iron loss therein was much reduced.

Steel 12 is a comparative sample of 6.5 wt. % Si steel, in which the iron loss is the smallest among all types of conventional Si steel. Steel 12 had good magnetic properties, but its workability was very poor.

As demonstrated herein, the steel sheets of the present invention all have extremely excellent workability, while having good corrosion resistance owing to Cr therein. In addition, the iron loss in the steel sheets of the invention was reduced nearly to the same degree as in sheets of conventional 6.5 wt. % Si steel.

EXAMPLE 2

In the same manner as in Example 1, prepared were various types of steel ingots having different compositions as in Table 5. Also in the same manner as in Example 1, those ingots were rolled into sheets, and evaluated for their properties. In this Example 2, however, the hot-rolled sheet samples of 2.3 mm thick, of which the transition temperature was not higher than 200° C., were, after having been shot-blasted at their surfaces, heated at 300° C. and then directly warm-rolled without being further re-heated; and those of which the transition temperature was higher than 200° C. were, after having been shot-blasted at their surfaces, heated at 450° C., and then warm-rolled while being re-heated in every rolling pass. The samples were evaluated in the same manner as in Example 1 for the toughness of the hot-rolled sheets, the magnetic properties, the electric resistance and the corrosion resistance of the final sheets. The data obtained are shown in Table 6.

TABLE 5

| Steel No. | C (ppm) | Si (%) | Mn (%) | P (ppm) | S (ppm) | Cr (%) | Al (%) | N (ppm) | O (ppm) | C + N (ppm) | Remarks |
|---|---|---|---|---|---|---|---|---|---|---|---|
| 21 | 10 | 6.5 | 0.003 | 4 | 3 | — | 0.010 | 7 | 12 | 17 | Comparative Sample |
| 22 | 11 | 4.1 | 0.003 | 3 | 3 | 1.4 | 2.1 | 11 | 10 | 22 | Comparative Sample |
| 23 | 10 | 4.0 | 0.003 | 3 | 3 | 4.5 | 2.1 | 10 | 12 | 20 | Sample of the Invention |
| 24 | 12 | 2.5 | 0.003 | 4 | 5 | 4.4 | 0.43 | 13 | 10 | 25 | Sample of the Invention |
| 25 | 6 | 11.1 | 0.004 | 3 | 3 | 4.5 | 2.7 | 7 | 8 | 13 | Comparative Sample |
| 26 | 9 | 4.3 | 0.002 | 5 | 4 | 4.5 | 6.3 | 11 | 10 | 20 | Comparative Sample |
| 27 | 8 | 3.5 | 0.22 | 0.33% | 3 | 4.6 | 2.0 | 8 | 13 | 16 | Sample of the Invention |
| 28 | 22 | 4.2 | 0.15 | 3 | 5 | 4.5 | 2.2 | 35 | 16 | 57 | Sample of the Invention |
| 29 | 55 | 4.3 | 0.13 | 5 | 7 | 4.4 | 2.1 | 58 | 18 | 113 | Comparative Sample |
| 30 | 0.8 | 4.1 | 0.001 | 1 | 1 | 5.0 | 1.9 | 45 | 5 | 5 | Sample of the |

TABLE 5-continued

| Steel No. | C (ppm) | Si (%) | Mn (%) | P (ppm) | S (ppm) | Cr (%) | Al (%) | N (ppm) | O (ppm) | C + N (ppm) | Remarks |
|---|---|---|---|---|---|---|---|---|---|---|---|
| | | | | | | | | | | | Invention |
| 31 | 2 | 2.8 | 0.010 | 3 | 2 | 1.8 | 1.7 | 5 | 11 | 7 | Sample of the Invention |
| 32 | 13 | 3.4 | 0.24 | 5 | 4 | — | 0.015 | 7 | 14 | 20 | Comparative Sample |

TABLE 6

| Steel No. | Transition Temperature (° C.) | Heating Method for Warm Rolling | Specific Resistivity (μΩcm) | Iron Loss (W/kg) | Corrosion Resistance | Remarks |
|---|---|---|---|---|---|---|
| 21 | >250 | 450° C. in every pass | 85 | 18 | poor | Comparative Sample |
| 22 | 180 | 450° C. in every pass | 103 | 21 | poor | Comparative Sample |
| 23 | 40 | 300° C. once | 118 | 16 | good | Sample of the Invention |
| 24 | −60 | 300° C. once | 72 | 19 | good | Sample of the Invention |
| 25 | >250 | 450° C. in every pass | 171 | 23 | good | Comparative Sample |
| 26 | >250 | 450° C. in every pass | 164 | 22 | good | Comparative Sample |
| 27 | 50 | 300° C. once | 122 | 16 | good | Sample of the Invention |
| 28 | 70 | 300° C. once | 122 | 16 | good | Sample of the Invention |
| 29 | 180 | 450° C. in every pass | 121 | 22 | medium | Comparative Sample |
| 30 | −30 | 300° C. once | 119 | 14 | good | Sample of the Invention |
| 31 | −70 | 300° C. once | 85 | 16 | good | Sample of the Invention |
| 32 | 30 | 300° C. once | 57 | 24 | poor | Comparative Sample |

Steel 21 is a comparative sample of conventional steel (6.5 wt. % Si). Steel 21 was extremely brittle, and its ordinary cold or warm rolling was difficult. However, this had good magnetic properties.

The object of the present invention is to provide steel sheets having workability much better than that of the conventional 6.5 wt. % Si steel sheet of this comparative sample and in which the high-frequency iron loss is at most the same as or is lower than that in the conventional 6.5 wt. % Si steel sheet. Specifically, the present invention is directed to steel sheets having a ductility-brittleness transition temperature of not higher than about 200° C., preferably not higher than about 100° C., more preferably not higher than about 70° C. The iron loss in the steel sheets to which the invention is directed is not higher than about 20 W/kg, preferably not higher than about 18 W/kg, relative to the magnetic flux density of 0.1 T at a frequency of 10 kHz.

Steel 22 is a comparative sample, of which the Cr content was smaller than the range defined in the invention. The workability of Steel 22 was poor. Steel 23 and Steel 24 are samples of the invention, which had a low transition temperature and had good workability adaptable to ordinary warm rolling. The iron loss in Steel 23 was lower than that in the comparative sample of 6.5 wt. % Si steel. The iron loss in Steel 24 was nearly the same as that in the 6.5 wt. % Si steel. Steel 25 contained too much Si and Steel 26 contained too much Al, and their workability was poor. Steel 27 is a sample of the invention, to which were added P and Mn. This was workable in ordinary warm rolling, and the iron loss in this sample was low. Steel 28 and Steel 29 contained an increased amount of (C+N). The (C+N) content of Steel 28 is within the range of the invention, while that of Steel 29 oversteps the range of the invention. The workability of Steel 29 was poor, and the iron loss therein was high. Steel 30 and Steel 31 are both samples of the invention, of which (C+N) content was much reduced. The workability of these samples was better, and the iron loss therein was much reduced. Thus, these samples are both extremely excellent. Steel 32 is a comparative sample of 3.4 wt. % Si steel, which is similar to ordinary Si steel. The iron loss in Steel 32 was high.

EXAMPLE 3

Herein demonstrated are the properties of different types of steel sheets, which may vary depending on the thickness of the final sheets. In the same manner as in Example 1, prepared were various types of steel ingots having different compositions as in Table 7. Also in the same manner as in Example 1, those ingots were rolled into sheets and evaluated for their properties. In this Example 3, however, the hot-rolled sheet samples of 2.3 mm thick, of which the transition temperature was not higher than 200° C., were, after having been shot-blasted at their surfaces, heated at 300° C. and then directly warm-rolled without being further re-heated. The samples were evaluated in the same manner as in Example 1 for the magnetic properties, the electric resistance and the corrosion resistance of the final sheets. The data obtained are shown in Table 8.

TABLE 7

| Steel No. | C (ppm) | Si (%) | Mn (%) | P (ppm) | S (ppm) | Cr (%) | Al (%) | N (ppm) | O (ppm) | C + N (ppm) | Remarks |
|---|---|---|---|---|---|---|---|---|---|---|---|
| 41 | 18 | 3.1 | 0.23 | 5 | 5 | — | 0.13 | 11 | 14 | 29 | Comparative Sample |
| 42 | 10 | 3.1 | 0.24 | 3 | 2 | 3.3 | 0.05 | 11 | 10 | 21 | Sample of the Invention |
| 43 | 9 | 4.2 | 0.003 | 3 | 2 | 4.1 | 0.9 | 12 | 13 | 21 | Sample of the Invention |

TABLE 8

| Steel No. | Specific Resistivity ($\mu\Omega \cdot$ cm) | Iron Loss (thickness 0.1 mm) | Iron Loss (thickness: 0.25 mm) | Iron Loss (thickness: 0.5 mm) | Corrosion Resistance | Remarks |
|---|---|---|---|---|---|---|
| 41 | 55 | 18 | 38 | 64 | poor | Comparative Sample |
| 42 | 69 | 11 | 20 | 45 | good | Sample of the Invention |
| 43 | 100 | 9 | 17 | 33 | good | Sample of the Invention |

In the samples of the invention (Steel 42 and Steel 43), the iron loss was reduced to a maximum value of 20 W/kg when the thickness of the sheets was reduced to 0.25 mm or less. However, in order to reduce the iron loss in the conventional 3 wt. % Si steel sheet (Steel 41) to the same degree as in the samples of the invention, the thickness of the conventional 3 wt. % Si steel sheet must be reduced to 0.1 mm or so. Also for the steel sheets of the invention, their thickness must be at a maximum of 0.4 mm in order that the iron loss therein is reduced to a maximum of 20 W/kg.

EXAMPLE 4

Herein demonstrated are the properties of hot-rolled steel sheets of which the thickness is varied. A sample of Steel 43 in Example 3 (4.1 wt. % Cr-4.2 wt. % Si-0.9 wt. % Al) was processed herein. In the same manner as in Example 1, the raw materials for the sample of Steel 43 were melted into steel ingots. These were cut into pieces having a size of 40 mm×60 mm×100 mm, then heated in Ar at 1100° C., kept at temperature for 30 minutes, then hot-rolled into sheets having a thickness of 20 mm, re-heated at 1100° C., kept at temperature for 15 minutes, and again hot-rolled into sheets having a predetermined thickness as in Table 9.

Of each hot-rolled sheet, cut out were Charpy test pieces having a thickness of 1.0 mm, a width of 10 mm and a length of 55 mm. Each test piece was V-notched to a length of 2 mm. The lengthwise direction of each test piece was parallel to the rolling direction thereof. All test pieces were subjected to a Charpy test at different temperatures at intervals of 25° C. The ductility-brittleness transition temperature of each test piece, at which the area percent brittle fracture of the test piece was 50%, was obtained.

Next, the hot-rolled sheet samples were shot-blasted, and then cold-rolled or warm-rolled. During the cold-rolling or warm-rolling, no intermediate annealing was effected. In every one rolling pass, the roll gap was reduced by 0.1 to 0.2 mm, and the sheets were finally reduced to a final thickness of 0.20 mm. For cold rolling, the hot-rolled sheets were directly rolled at room temperature. For warm rolling, they were pre-heated at 150° C. and then rolled. In the latter case, the sheets were not re-heated during the warm-rolling process.

As in Table 9, the thinner hot-rolled sheets had much better workability, and their rolling ability during cold or hot rolling was much improved. The improvements in the cold or warm rolling ability of the hot-rolled sheets were greater, when the thickness of the sheets was 3.0 mm or less.

TABLE 9

| Steel No. | Thickness of Hot-rolled Sheet (mm) | Transition Temperature (° C.) | Cold Rolling | Warm Rolling |
|---|---|---|---|---|
| 43 | 5.0 | 120 | cracked | cracked |
| 43 | 4.0 | 110 | cracked | cracked |
| 43 | 3.0 | 70 | cracked | good |
| 43 | 2.0 | −10 | good | good |
| 43 | 1.0 | −30 | good | good |

As has been described in detail hereinabove, the present invention has realized excellent electromagnetic steel sheets of which the high-frequency magnetic properties and also the workability are comparable to or better than those of conventional Si steel or Si—Al steel sheets having an Si content of up to 6.5% by weight. In addition, the steel sheets of the invention have other advantages of good corrosion resistance and low production costs. Having all-round abilities, the electromagnetic steel sheets of the invention are extremely excellent.

While the invention has been described in detail and with reference to specific embodiments thereof, it will be apparent to one skilled in the art that various changes and modifications can be made therein without departing from the spirit and scope thereof.

What is claimed is:

1. An electromagnetic steel sheet having excellent high-frequency electromagnetic properties, comprising:

Cr in an amount of from about 1.5 to 20% by weight, Si in an amount of from about 2.5 to 10% by weight and Al in an amount of from about 0.5 to 5% by weight, while having a maximum total amount of C and N of about 100 ppm by weight, said steel having a minimum specific resistivity of about 60 $\mu\Omega\cdot$cm.

2. An electromagnetic steel sheet having excellent high-frequency electromagnetic properties, comprising: Cr in an amount of from about 1.5 to 20% by weight, Si in an amount of from about 2.5 to 10% by weight, Al in an amount of from about 0.5 to 5% by weight and one or two elements selected from the group consisting of Mn and P, each in a maximum amount of about 1% by weight said steel having a specific resistivity of about 60 $\mu\Omega\cdot$cm.

3. The electromagnetic steel sheet claimed in any one of claims 1 or 2, which has a thickness of from about 0.01 to 0.4 mm.

* * * * *

UNITED STATES PATENT AND TRADEMARK OFFICE

CERTIFICATE OF CORRECTION

PATENT NO. : 6,162,306
DATED : December 19, 2000
INVENTOR(S) : Takajo et al.

It is certified that error appears in the above-identified patent and that said Letters Patent is hereby corrected as shown below:

Column 11, Table 4, continued

At steel no. 11, at the subheading "Specific Resistivity", please change "85" to -- 133 --; at the subheading "Iron Loss", please change "18" to -- 13 --; at the subheading "Corrosion Resistance", please change "poor" to -- good --; and at the subheading "Remarks", please change "Comparative Sample" to -- Sample of the Invention.

Signed and Sealed this

Twentieth Day of November, 2001

*Attest:*

Nicholas P. Godici

*Attesting Officer*

NICHOLAS P. GODICI
*Acting Director of the United States Patent and Trademark Office*